US006072017A

United States Patent [19]

Blizzard et al.

[11] Patent Number: 6,072,017

[45] Date of Patent: Jun. 6, 2000

[54] MONOACRYLATE-POLYETHER TREATED FIBER

[75] Inventors: John Donald Blizzard, Bay City; Michael Ward Skinner, Midland, both of Mich.

[73] Assignee: Dow Corning Corporation, Midland, Mich.

[21] Appl. No.: 09/174,668

[22] Filed: Oct. 19, 1998

[51] Int. Cl.[7] ..... C08G 77/06

[52] U.S. Cl. ..... 528/26; 528/38; 428/447

[58] Field of Search ..... 528/26, 38; 428/447

[56] References Cited

U.S. PATENT DOCUMENTS 4,247,592 1/1981 Kalinowski ..... 428/266
4,366,001 12/1982 Ona et al. ..... 106/287.11
4,705,704 11/1987 Lane et al. ..... 427/389.9
4,978,561 12/1990 Cray et al. ..... 427/387
5,739,192 4/1998 Blizzard et al. ..... 528/26

*Primary Examiner*—Robert Dawson
*Assistant Examiner*—Jeffrey B. Robertson
*Attorney, Agent, or Firm*—William F. Boley

[57] ABSTRACT

A fiber treated with a treating agent which is the reaction product of a polysiloxane having at least one aminofunctional group substituted on a silicon atom and having at least one hydrogen—nitrogen bond with a monoacrylate polyether. The present treated fiber has good hand, little yellowing, and improved hydrophilicity when compared to fibers treated with convention aminofunctional polyorganosiloxanes.

15 Claims, No Drawings

MONOACRYLATE-POLYETHER TREATED FIBER

BACKGROUND OF INVENTION

The present invention is fiber treated with a treating agent which is the reaction product of a polysiloxane having at least one aminofunctional group substituted on a silicon atom and having at least one hydrogen—nitrogen bond with a monoacrylate polyether. The treated fiber has good hand, little yellowing, and improved hydrophilicity when compared to fibers treated with convention aminofunctional polysiloxanes.

It is known to treat textile fibers, such as cellulosic and synthetic fibers, with polyorganosiloxanes to impart properties such as water repellency. It is also known to treat textile fabrics with aminofunctional silicone fluids to confer desirable properties such as "hand" to the fabric.

Kalinowski, U.S. Pat. No. 4,247,592, teaches treating synthetic textiles with triorganosiloxy endblocked polydiorganosiloxanes having amino or substituted amino groups attached through an alkylene bride to monofunctional and/or difunctional siloxy units.

Ona et al., U.S. Pat. No. 4,366,001, teach fiber treating compositions which contain two types of organofunctional polysiloxanes. One polysiloxane bears aminofunctional organic radicals, carboxy-functional organic radicals, or epoxy-functional radicals and the other bears another type or organofunctional radical selected from the same group. In addition, at least one of the organofunctional polysiloxanes bears one or more polyoxyalkylene radicals.

Lane et al., U.S. Pat. No. 4,705,704, teach treating fabrics with emulsions of trialkylsiloxy terminated polysiloxanes having at least one amino or substituted amino group linked to at least one trifunctional siloxy unit of the polysiloxane through an alkylene or arylene bridge.

Cray et al., U.S. Pat. No. 4,978,561, teach applying to a fabric an organosilicon compound having a group described by formula $=NCO(CH—)_nOH$ connected with a silicon atom of the organosilicon compound.

Blizzard et al., U.S. Pat. No. 5,739,192, teach compositions which are the reaction product of a polysiloxane having at least one aminofunctional group substituted on a silicon atom and having at least one hydrogen—nitrogen bond with acrylate. Blizzard et al. suggest that such compositions may be useful as fiber treatment agents, but do not recognize the particular utility of compositions claimed herein as fiber treating agents and provide no enabling for such treatment.

SUMMARY OF INVENTION

The present invention is fiber treated with a treating agent which is the reaction product of a polysiloxane having at least one aminofunctional group substituted on a silicon atom and having at least one hydrogen—nitrogen bond with a monoacrylate polyether. The present treated fiber has good hand, little yellowing, and improved hydrophilicity when compared to fibers treated with convention aminofunctional polyorganosiloxanes

DESCRIPTION OF INVENTION

The present invention is fiber treated with a treating agent comprising the reaction product of:

A) a polysiloxane selected from the group consisting of linear polysiloxanes described by formula $$R^1{}_3SiO(SiR^1{}_2O)_xSiR^1{}_3 \text{ and} \quad (1)$$

cyclic polysiloxanes described by formula $$(R^1{}_2SiO)_z, \quad (2)$$

where each $R^1$ is independently selected from the group consisting of hydroxyl, alkoxy, alkyls comprising 1 to about 4 carbon atoms, aryl, and an amine functional group, with the proviso that at least one $R^1$ comprise an amine functional group having at least one hydrogen atom bonded to nitrogen and is attached to a silicon atom through a silicon—carbon bond and at least 50 mole percent of the substituents bonded to silicon are alkyl or aryl, x is an average value of from 0 to about 1000, and z has a value of at least 3; and (B) monoacrylate polyether described by formula $$CH_2{=}CR^2{-}C(O){-}O{-}Q \quad (3)$$

where $R^2$ is selected from the group consisting of hydrogen and methyl and Q is a polyether.

The fiber which can be treated with the treating agent of this invention are those which are known in the art to be treatable by aminofunctional polysiloxanes. The fiber includes, for example, natural fibers such as wool, silk, linen, and cotton; regenerated fibers such as rayon and acetate; synthetic fibers such as polyesters, polyamides, vinylon, polyacrylonitriles, polyethylenes, polypropylenes, spandex, and blends. The fiber can be treated, for example, as filaments, staples, tows, yarns, woven materials, knitted materials, unwoven materials, and resin processed cloths. The fiber to be treated can be in the form of blends of natural fibers, synthetic fibers, and natural and synthetic fibers. Preferred are when the fiber to be treated are in the form of sheets of woven materials, knitted materials, and unwoven materials.

The treating agent of the present invention is the reaction product of the components described by formulas (1) and (3) or (2)and (3) as described above. The method of preparing such reaction products is described in Blizzard et al., U.S. Pat. No. 5,739,192, which is incorporated herein by reference for teaching such reaction products and methods for their making. The linear and cyclic polysiloxanes described by formulas (1) and (2) can have a viscosity ranging from about 5 to 50,000 mPa.s at 25° C. and molecular weights within a range of about 300 to 25,000. While x can be an average value within a range of 0 to about 1000, it is preferred that x be an average value within a range of 0 to about 500. Even more preferred is when x is an average value within a range of 0 to about 100. The value z can be any number of 3 or greater and preferably is a value of 3 to about 20.

In the above formulas (1) and (2), each $R^1$ is independently selected from the group consisting of hydroxyl, alkoxy, alkyl comprising 1 to about 4 carbon atoms, aryl, and amine functional groups, with the proviso that at least one $R^1$ substituent comprise an amine functional group having at least one hydrogen atom bonded to nitrogen and is bonded to a silicon atom through a silicon—carbon bond and at least 50 mole percent of the substituents bonded to silicon are alkyl or aryl groups. When $R^1$ comprises an organic substituent, the organic substituent can be unsubstituted or substituted. $R^1$ can be, for example, alkoxy groups such as methoxy and ethoxy; alkyl groups such as methyl, ethyl, isopropyl, tertiary-butyl, and 3,3,3-trifluoropropyl; and aryl groups such as phenyl.

In the polysiloxanes described by formulas (1) and (2) at least one $R^1$ substituent must comprise an amine functional group having at least one hydrogen atom bonded to nitrogen and is attached to a silicon atom through a silicon—carbon bond. It is preferred that the amine functional group have general formula $$R^3{}_2—N—(—R^4R^3N)_k—R^5—. \quad (4)$$

In formula (4), each $R^3$ can be independently selected from the group consisting of hydrogen and unsubstituted and substituted monovalent hydrocarbon radicals, with the proviso that at least one $R^3$ is hydrogen. $R^3$ can be for example, alkyl groups comprising 1 to about 18 carbon atoms, such as methyl, ethyl, propyl, isobutyl, octadecyl, 3-chloropropyl, and 3,3,3-trifluoropropyl; aryl groups comprising 6 to about 16 carbon atoms such as phenyl, naphthyl, and chlorophenyl; arylalkyl groups comprising 7 to about 9 carbon atoms such as benzyl, phenylethyl, and 3-phenylpropyl; and alkylaryl groups comprising 7 to about 16 carbon atoms such as tolyl, xylyl, and propyltolyl. It is preferred that at least one $R^3$ group be hydrogen with the remaining $R^3$ groups being methyl. In formula (4), $R^4$ is a divalent hydrocarbon group preferable comprising about 2 to 6 carbon atoms such as ethylene, trimethylene, tetramethylene, and hexamethylene. Preferred is when $R^4$ is ethylene. In formula (4), the value k is preferably 0, 1, or 2. In formula (4), $R^5$ is a divalent hydrocarbon radical forming a carbon—silicon bond with the polysiloxanes described by formulas (1) and (2). Preferred is when $R^1$ is selected from the group consisting of propylene, butylene, and isobutylene.

Examples of $R^1$ which comprise an amine functional group having at least one hydrogen atom bonded to nitrogen include, $—CH_2CH_2CH_2NH_2$, $—CH_2CH_2CH_2N(H)CH_2CH_2NH_2$, $—CH_2CH_2CH_2N(H)CH_2CH_2N(H)CH_2CH_2NH_2$, $—CH_2CH_2CH_2CH_2NH_2$, $—CH_2CH_2CH_2CH_2CH_2NH_2$, $—CH_2CH_2CH_2N(H)Et$, $—CH_2CH_2CH_2N(H)CH_2CH_2NMe_2$, $—CH_2CH_2CH_2N(H)Et$, $—CH_2CH(Me)CH_2N(H)CH_2CH_2NH_2$, and $—CH_2CH(Me)CH_2NH_2$; where Me and Et represent methyl and ethyl respectively.

The treating agent of the present invention is the reaction product of the polysiloxanes described by formulas (1) and (2) and a monoacrylate polyether described by formula (3) $CH_2{=}CR_2—C(O)—O—Q$, where $R^2$ is selected from the group consisting of hydrogen and methyl and Q is a polyether. In formula (2), Q can be, for example, a polyether selected from the group consisting of $—(CH_2)_y(OCH_2CH_2)_a(OCH_2CHCH_3)_b\{OCH_2CH(CH_2CH_3)\}_cOR^6$, $—(CH_2)_y(OCH_2CH_2)_aOR^6$, $—(CH_2)_y(OCH_2CH_2)_a(OCH_2CHCH_3)_bOR^6$, $—(CH_2)_y\{OCH_2CH(CH_2CH_3)_c\}OR^6$, $—(CH_2)_y(OCH_2CHCH_3)_b\{OCH_2CH(CH_2CH_3)\}_cOR^6$, $—(CH_2)_y(OCH_2CH_2)_a\{OCH_2CH(CH_2CH_3)\}_cOR^6$, and $—(CH_2)_y(OCH_2CHCH_3)_bOR^6$; where $R^6$ can be hydrogen, an alkyl radical comprising 1 to about 4 carbon atoms, an aryl radical comprising 6 to about 12 carbon atoms, an aralkyl radical comprising at least 6 carbon atoms, and an acyl radical and y=2 to 20, a=1 to 120, b=1 to 50, and c=1 to 50.

Examples of polyethers within the scope of Q include $—(CH_2CH_2O)_8H$, $—(CH_2CH_2O)_{12}H$, $—(CH_2CH_2O)_8CH_3$, $—(CH_2CH_2O)_{12}CH_3$, $—(CH_2CH_2O)_8C(O)CH_3$, $—(CH_2CH_2O)_{20}H$, $—(CH_2CH(CH_2CH_2)O)_{10}CH_3$, and $—(CH_2CHCH_3O)_5C(O)CH_3$. The monoacrylate polyether can be, for example, polyethylene glycol monoacrylate and polypropylene glycol monoacrylate.

In forming the reaction product which is the treating agent of the present invention, the ratio of —NH provided by the polysiloxane to the monoacrylate polyether can be varied from about 1000 to 0.001, however ratios of 1 or more are preferred.

The method of treating the fiber with the treating agent is not critical to the present invention and can generally be any of those known in the art for treating such fibers. The treating agent may be applied to the fiber, for example, as a solvent solution, an aqueous dispersion, or an emulsion. In a preferred method, the fiber is treated with an emulsion comprising about 0.1 to 50 weight percent of the treating agent. Preferred is when the emulsion comprises about 0.5 to 5 weight percent of the treating agent. One or more suitable emulsifying agents may be used to facilitate formation of the emulsion of the treating agent. The emulsifying agent may be, for example, a non-ionic emulsifying agent or a cationic emulsifying agent, or a mixture of both. Examples of useful nonionic emulsifying agent are described in the Examples herein. If desired a small amount of acetic acid or similar acid may be added to assist in dispersing the treating agent into the aqueous phase of the emulsion. The treating agent may be applied to the fiber by such methods as dipping, spraying, or brushing and then heated to a temperature less than the decomposition point or melting point of the treating agent and fiber to facilitate removal of solvent or water from the fiber.

Generally, it is preferred that after drying the treated fibers comprise about 0.01 to 2 weight percent of the treating agent. The present inventors have found that generally this weight of treating agent may provide for fibers having good hand, low yellowing, and an improved hydrophilicity when compared to fibers treated with conventional aminofunctional polysiloxane treating agents.

The following examples are provided to illustrate the present invention. These examples are not intended to limit the scope of the claims herein.

Treating Agent Preparation and Description

Treating Agent 1 (Reference) was a dimethyl (aminoethylaminopropyl)methylsiloxane having a viscosity of 2000 mP.s at 25° C. This treating agent is a standard silicone softener used in the textile industry.

Treating Agent 2, N-propyl-N-((2-hydroxyethyl) propanoate)ethylenediamino functional dimethylpolysiloxane, was prepared as follows: 150 g of a 2 mole percent (mol %) ethylenediamine functional siloxane having a degree of polymerization (dp) of 100 was reacted with 4.6 g of 2-hydroxyethylacrylate under a nitrogen atmosphere at 75° C. for 5 hours.

Treating Agent 3, aminopropylpolyethyleneglycol ester functional dimethyl polysiloxane, was prepared as follows: 50 g of a 2 mol % ethylenediamine functional siloxane having a dp of 300 was reacted with 2.5 g of 2(2-ethoxyethoxy)ethyl acrylate under a nitrogen atmosphere at 75° C. for 5 hours.

Treating Agent 4, aminopolypropylene glycol ester functional dimethylpolysiloxane, was prepared as follows: 100 g of a 2 mol % ethylenediamino functional siloxane having a dp of 100 was reacted with 10.4 g of polypropylene glycol monomethylacrylate under a nitrogen atmosphere at 75° C. for 5 hours.

Test procedures

An emulsion of each treating agent was prepared by forming a mixture containing 40 g of the treating agent, 6 g of a nonionic surfactant (Tergitol TMN-6, Union Carbide Chemicals & Plastics Company, Inc., Danbury, Conn.), 4 g of nonionic surfactant (Tergitol 15-S-7, Union Carbide Chemicals & Plastics Company, Inc.), 149 g water, and 0.8 g acetic acid and emulsifying the mixture by sonification.

The resulting emulsions were applied to a cotton fabric using a Werner Mathis textile padder (Mathis U.S.A. Inc., Concord, N.C.) to provide a treated cotton fabric retaining the emulsion at 1 weight percent. The fabric was dried in a forced air oven at 150° C. for 3 minutes and then allowed to dry for 24 hours at room temperature. The treated fabrics where evaluated for softness (hand) by a panel of hand experts against the reference sample and scored on a scale 1 to 5 with 5 being the softest. Hydrophilicity was evaluated for each treated fabric by placing a drop of water on the fabric and measuring the time in seconds (s) for the drop to be completely absorbed into the fabric. Yellowing of the fabric as a result of the treatment procedure was measured using a colorimeter to measure reflectance of light off the fabric, with the higher the measured value the whiter the fabric. The results of these evaluations are reported in Table 1.

TABLE 1

| | Evaluation Results | | |
|---|---|---|---|
| Treating Agent | Hand | Hydrophilicity (s) | Yellowing |
| 1 | 3 | 180 | 65 |
| 2 | 3 | 6 | 69 |
| 3 | 3 | 11 | 71 |
| 4 | 2 | 15 | 72 |
| control* | 1 | 1 | 74 |

*untreated cotton fabric

We claim:

1. A fiber treated with a treating agent comprising the reaction product of

A) a polysiloxane selected from the group consisting of linear polysiloxanes described by formula $$R^1{}_3SiO(SiR^1{}_2O)_xSiR^1{}_3$$

and cyclic polysiloxanes described by formula $$(R^1{}_2SiO)_2$$

where each $R^1$ is independently selected from the group consisting of hydroxyl, alkoxy, alkyls comprising 1 to about 4 carbon atoms, aryl, and an amine functional group, with the proviso that at least one $R^1$ comprises an amine functional group having at least one hydrogen atom bonded to nitrogen and attached to a silicon atom through a silicon—carbon bond and at least 50 mole percent of the substituents bonded to silicon are alkyl or aryl, x is an average value within a range of 0 to about 1000, and z has a value of at least 3, and (B) monoacrylate polyether described by formula $$CH_2{=}CR^2{-}C(O){-}O{-}Q$$

where $R^2$ is selected from the group consisting of hydrogen and methyl and Q is a polyether.

2. A fiber according to claim 1, where x is an average value within a range of 0 to about 1000.

3. A fiber according to claim 1, where x is an average value within a range of 0 to about 500.

4. A fiber according to claim 1, where x is an average value within a range of 0 to about 100.

5. A fiber according to claim 1, where z is a value of 3 to about 20.

6. A fiber according to claim 1, where the amine functional group has general formula $R^3{}_2{-}N{-}({-}R^4R^3N)_k{-}R^5{-}$, where each $R^3$ is independently selected from the group consisting of hydrogen and unsubstituted and substituted monovalent hydrocarbon radicals, with the proviso that at least one $R^3$ is hydrogen, $R^4$ is a divalent hydrocarbon group, $R^5$ is a divalent hydrocarbon radical forming a carbon—silicon bond with the linear polysiloxanes or cyclic polysiloxane, and k is 0, 1, or 2.

7. A fiber according to claim 6, where each $R^3$ is selected from the group consisting of hydrogen and methyl, $R^4$ is ethylene, and $R^5$ is selected from the group consisting of propylene, butylene, and isobutylene.

8. A fiber according to claim 1, where the monoacrylate polyether is selected from the group consisting of polyethylene glycol monoacrylate and polypropylene glycol monoacrylate.

9. A fiber according to claim 1, where the ratio of hydrogen bonded nitrogen to the monoacrylate polyether is within a range of about 1000 to 0.001.

10. A fiber according to claim 1, where the ratio of hydrogen bonded nitrogen to the monoacrylate polyether is 1 or greater.

11. A fiber according to claim I comprising about 0.01 to 2 weight percent of the treating agent.

12. A fiber according to claim 1, where the treating agent is N-propyl-N-((2-hydroxyethyl)propanoate) ethylenediamino functional dimethylpolysiloxane.

13. A fiber according to claim 1, where the treating agent is aminopropylpolyethyleneglycol ester functional dimethylpolysiloxane.

14. A fiber according to claim 1, where the treating agent is aminopolypropylene glycol ester functional dimethylpolysiloxane.

15. A fabric treated with a treating agent comprising the reaction product of A) a polysiloxane selected from the group consisting of linear polysiloxanes described by formula $$R^1{}_3SiO(SiR^1{}_2O)_xSiR^1{}_3$$

and cyclic polysiloxanes described by formula $$(R^1{}_2SiO)_z$$

where each $R^1$ is independently selected from the group consisting of hydroxyl, alkoxy, alkyls comprising 1 to about 4 carbon atoms, aryl, and an amine functional group, with the proviso that at least one $R^1$ comprises an amine functional group having at least one hydrogen atom bonded to nitrogen and attached to a silicon atom through a silicon—carbon bond and at least 50 mole percent of the substituents bonded to silicon are alkyl or aryl, x is an average value within a range of 0 to about 1000, and z has a value of at least 3, and (B) monoacrylate polyether described by formula $$CH_2{=}CR^2{-}C(O){-}O{-}Q$$

where $R^2$ is selected from the group consisting of hydrogen and methyl and Q is a polyether.

* * * * *